US006124676A

United States Patent [19]

Salavin et al.

[11] Patent Number: 6,124,676

[45] Date of Patent: Sep. 26, 2000

[54] BI-SUBSTRATE PLASMA PANEL

[75] Inventors: Serge Salavin, Saint Egreve; Henri Doyeux, Beaucroissant; Jacques Deschamps, Grenoble, all of France

[73] Assignee: Thomson Tubes Electroniques, Meudon la Foret, France

[21] Appl. No.: 09/381,277

[22] PCT Filed: Jan. 14, 1999

[86] PCT No.: PCT/FR99/00056

§ 371 Date: Sep. 20, 1999

§ 102(e) Date: Sep. 20, 1999

[87] PCT Pub. No.: WO99/36934

PCT Pub. Date: Jul. 22, 1999

[30] Foreign Application Priority Data

Jan. 20, 1998 [FR] France ..... 98 00558

[51] Int. Cl.[7] ..... G09G 3/10

[52] U.S. Cl. ..... 315/169.4; 313/238; 313/292; 313/268; 345/37; 345/55; 345/60

[58] Field of Search ..... 315/169.4, 169.1; 313/238, 268, 292, 257, 484, 485, 491, 584, 586; 345/37, 55, 60, 88

[56] References Cited

U.S. PATENT DOCUMENTS

| | | | |
|---|---|---|---|
| 3,892,998 | 7/1975 | Tsui et al. | 313/487 |
| 4,088,925 | 5/1978 | Deschamps | 315/13 |
| 4,575,721 | 3/1986 | Delgrange et al. | 340/776 |
| 4,650,434 | 3/1987 | Deschamps et al. | 445/2 |
| 5,030,888 | 7/1991 | Salavin et al. | 315/169.4 |
| 5,045,846 | 9/1991 | Gay et al. | 315/169.4 X |
| 5,066,890 | 11/1991 | Salavin et al. | 313/585 |
| 5,075,597 | 12/1991 | Salavin et al. | 315/169.4 |
| 5,086,257 | 2/1992 | Gay et al. | 315/169.4 |
| 5,237,315 | 8/1993 | Gay et al. | 315/169.4 X |
| 5,519,520 | 5/1996 | Stoller | 359/55 |
| 5,674,553 | 10/1997 | Shinoda et al. | 427/68 |
| 5,834,891 | 11/1998 | Novich | 313/495 |
| 5,867,135 | 2/1999 | Salavin et al. | 345/68 |

FOREIGN PATENT DOCUMENTS 2 699 717 6/1994 France .

*Primary Examiner*—Haissa Philogene

*Attorney, Agent, or Firm*—Oblon, Spivak, McClelland, Maier & Neustadt, P.C.

[57] ABSTRACT

A color two substrate alternating plasma display panel. The panel includes two tiles joined together so as to be opposite each other and defining a space therebetween. The space is filled with gas. One of the tiles has column electrodes which are approximately parallel, separated by a spacing and covered with at least one phosphor region. The other tile has at least one row electrode. The phosphor regions are provided with at least one recess placed at the intersection of a column electrode with the row electrode. A color pixel is formed by neighboring recesses lying within the same row electrode in adjacent phosphor regions. In order to obtain better light efficiency, the distance separating two adjacent recesses lying within adjacent phosphor regions and belonging to the same pixel is greater than the spacing so that space has a thickness greater than that required when two recesses are separated by approximately the spacing.

21 Claims, 8 Drawing Sheets

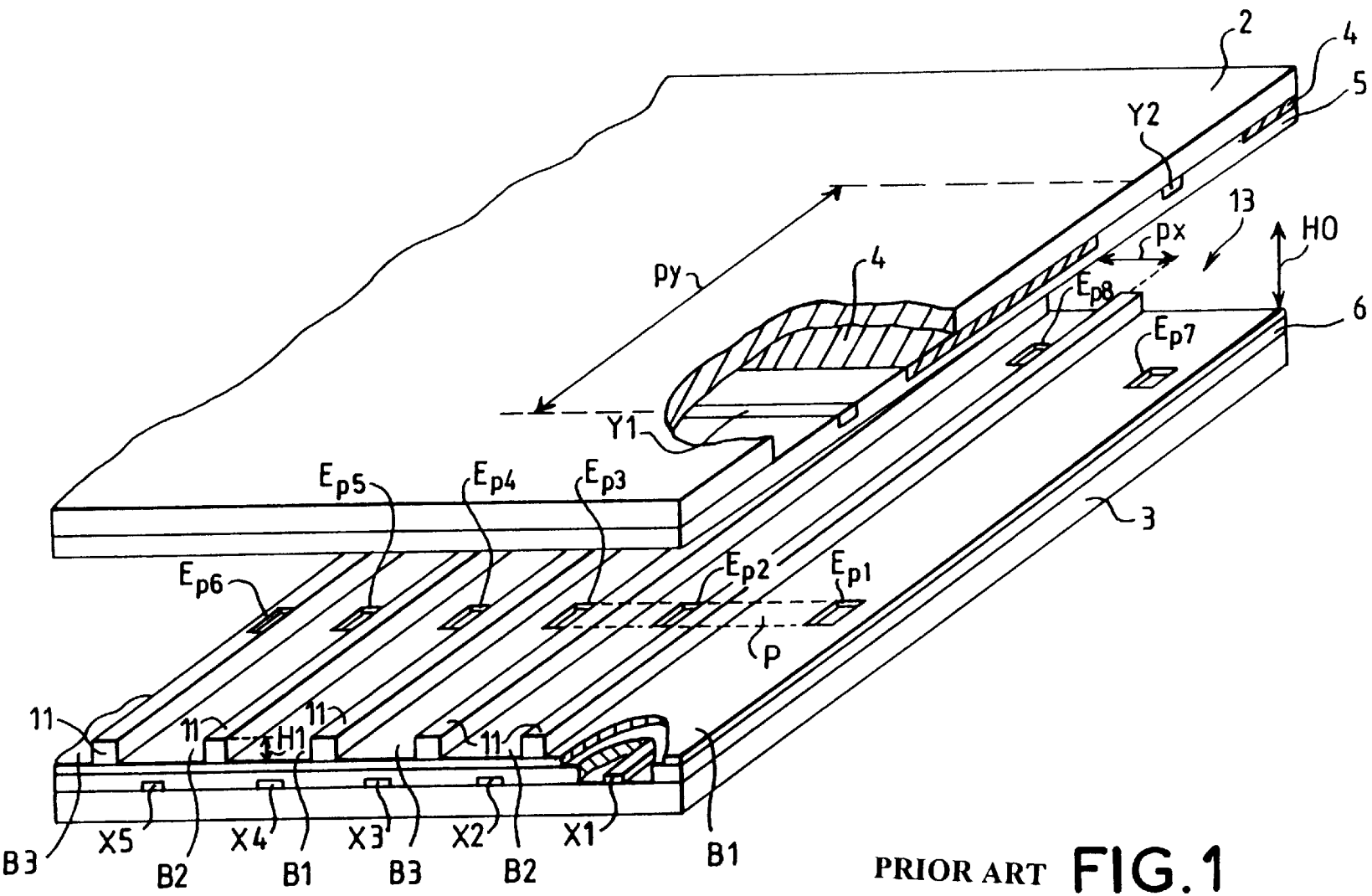
PRIOR ART FIG. 1

BI-SUBSTRATE PLASMA PANEL

BACKGROUND OF THE INVENTION

1. Field of the Invention

The present invention relates to colour plasma display panels, of the two-substrate alternating type, with improved light efficiency.

2. Discussion of the Background

Plasma panels suffer from a lack of electroptical performance compared with cathode-ray tubes, this being so whatever the production technique employed.

Colour plasma panels of the two-substrate alternating type operate on the principle of an electrical discharge in the gases and they use only two crossed electrodes, laying on different substrates, to define and control a discharge.

FIG. 1 shows such a plasma panel of the prior art. It comprises two substrates of tiles 2, 3, one of which, called the front tile 2, lies on the same side as an observer (who is not illustrated). This front tile 2 carries a first array of electrodes, called row electrodes, only two of which, Y1, Y2, are illustrated. The row electrodes Y1, Y2 are approximately parallel and spaced apart with a spacing py. The row electrodes Y1, Y2 are covered with a layer 5 of a dielectric material.

The second tile 3 or so-called rear tile is on the opposite side form the observer; it carries a second array of electrodes called column electrodes, only five of which, X1 to X5, are illustrated. The column electrodes X1 to X5 are approximately parallel and spaced apart with a spacing px. The spacing px is about one third of the spacing py and may be between, for example, 100 $\mu$m and 500 $\mu$m depending on the definition of the image.

The two tiles 2, 3 are generally made of glass. They are intended to be joined together so that the row electrodes Y1 to Y2 are approximately perpendicular to the column electrodes X1 to X5. Once they have been joined together, the two tiles 2, 3 define a space 13 which is intended to be filled with gas. The gas used is generally a neon-based gas.

The thickness H0 of the space 13 between the front tile 2 and the rear tile 3 must be as precise as possible, in order to obtain homogeneous discharges.

On the rear tile 3, the column electrodes X1 to X5 are also covered with a layer 6 of dielectric material. The dielectric layer 6 is itself covered with several groups of three phosphor stripes B1, B2, B3 corresponding, for example, to the colours green, red and blue, respectively. The phosphor stripes B1, B2, B3 are approximately parallel to the column electrodes X1 to X5. They have approximately the same spacing px as the column electrodes X1 to X5. One column electrode, for example X1, therefore lies beneath a phosphor stripe B1, approximately in the middle of it.

In general, the rear tile 3 also includes an array of barriers 11 approximately parallel to the column electrodes X1 to X5 and separated by the spacing px. They separate two adjacent phosphor stripes B1, B2. Their height H1 is generally less than the thickness H0 of the space 13 between the front tile 2 and the rear tile 3.

Two electrodes X1, Y1 lying on different tiles 2, 3 can include a discharge in the gas if they are at appropriate potentials. The discharge region has a cross section which corresponds approximately to the area facing the two opposed electrodes X1, Y1.

For the purpose of reducing the voltages to be applied to the electrodes in order to obtain a discharge, it is necessary to cut out holes or recesses Ep1, Ep2, Ep3, etc. in the phosphor stripes B1, B2, B3, in the surface facing between a row electrode Y1 and a column electrode X1. These recesses Ep1, Ep2 confine the discharge.

Conventionally in colour panels, three neighbouring recesses Ep1, Ep2, Ep3, level with the same row electrode Y1 but in three adjacent phosphor stripes B1, B2, B3, are used to form a trichromatic pixel P which can adopt a great number of colours.

The recesses Ep1, Ep2, Ep3 of the same pixel P are therefore aligned with the same row electrode Y1 and are separated by a distance equal to the spacing px.

To improve the contrast, the front tile 2 is often provided with a black matrix 4 in a form of black stripes extending between two row electrodes Y1, Y2. These black stripes 4 generally occupy an area of about half the area of the front tile 2.

The light efficiency of such two-substrate alternating panels varies in the same sense as the thickness H0 of the gas-filled space 13. It will be recalled with the light efficiency is the ratio of the luminance emitted by the panel to the electrical power that it consumes. Depending on the structure of the panel, this efficiency may actually vary between 0.5 and 1 lumen/watt for a value of the thickness H0 of about 100 micrometers.

However, the thickness H0 of the space 13 cannot be increased excessively with respect to this spacing px without running the risk of disturbing the operation of the panel. A discharge initiated at a recess may trigger spurious discharges at neighbouring recesses that should remain unenergized, especially in panels whose barriers are not full-height barriers.

In so-called coplanar panels, in which the discharges are established between two electrodes carried by the same tile, the light efficiency is not sensitive to the thickness of the gas-filled space.

It has already been proposed, in order to reduce the incidence of these spurious discharges, to use full-height barriers. In addition to their role of separating the differently-coloured phosphor stripes, these barriers have a role of confining the discharge occurring at a recess so that it does not induce a discharge at an neighbouring recess that must not be activated. These full-height barriers also serve as spacers between the two tiles. These barriers allow a greater thickness of the gas-filled space than that required with half-height barriers. However, it has been observed that these full-height barriers can impair the proper operation of the panel, particularly when high pixel bright-up rates is needed. These rates are required in television applications. Complete confinement between recesses lying on adjacent phosphor stripes, belonging to the same pixel, results in a lack of circulation of charges in the plasma and/or of ultraviolet photons capable of helping in discharge ignition.

Another drawback of these full-height barriers is that they are difficult to produce very accurately. They are often produced by successive screen-printing operations, and it is difficult to obtain a uniform thickness.

SUMMARY OF THE INVENTION

The objective of the present invention is to propose a colour two-substrate alternating plasma display panel which has, for the same resolution, an improved light efficiency, this improvement in the light efficiency neither degrading the operation of the panel nor degrading its intrinsic contrast. The improvement proposed does not make the manufacture of the various components of the plasma panel more complex and may even make the manufacture of some of these components easier.

To achieve this objective, the present invention is a colour two-substrate-type alternating plasma display panel comprising two tiles joined together so as to be opposite each other, defining a space intended to be filled with gas, one of the tiles having column electrodes which are approximately parallel, separated by a spacing px and each one being covered with at least one phosphor region, the other tile having at least one row electrode. The phosphor regions are provided with at least one recess placed at the intersection of a row electrode with a column electrode, this recess localizing discharges that can be produced between two electrodes. A colour pixel is formed by neighbouring recesses, located within the same row electrodes, in adjacent phosphor regions. According to the invention, in order to obtain a better light efficiency, the distance separating two neighbouring recesses, located in adjacent phosphor regions and belonging to the same pixel, is greater than the spacing so as to allow the space to have a thickness greater than that required when the two recesses are separated approximately by the spacing.

The recesses of the same pixel may be arranged in a triangle, which results in the greatest separation between apertures for the same resolution.

If the recesses of the same pixel are aligned, recesses located in separate phosphor regions responding to the same colour but on different column electrodes are also aligned, which allows a line in this colour, formed by these recesses to be very straight.

In order for the row electrode to follow the recesses of the same pixel, it may be subdivided into several subelectrodes.

It is possible for the subelectrodes to be connected together by at least two short circuits with a view to allowing self-healing should there be a break.

A variant is one in which the line electrode has at least one change of direction in order to follow the recesses of the same pixel. It may especially be in the form of a zig-zag.

The panel may also include barriers which separate two adjacent phosphor regions of different colours, these barriers having a height of less than the thickness of the space, thereby allowing the colorimetric response of the panel to be improved.

In order to increase the emissive area around the recesses, the successive barriers may be further apart at a recess than on either side of this recess. This results, for example, in a barrier pattern in the form of a broken line or in the form of a curved line.

It is possible to make the recesses deep enough to confine the discharges so as to avoid the use of barriers. Their omission is advantageous since they are difficult and require a long time to produce, and they represent approximately half the cost of producing the tile equipped with barriers.

In order to save on the phosphor, it is possible for the recesses to be formed from wells in a sublayer of an additional material, these wells being lined with phosphor without being filled up.

In order to further reduce the amount of phosphor, it is advantageous for a phosphor region to terminate in a rim which follows the mouth of a well.

The panel may also include the black matrix on the tile carrying the row electrode, for the purpose of improving the intrinsic contrast, and the black matrix may cover the tile apart from apertures which face the recesses and are tied to the recesses, these apertures having an area substantially greater than that of the recesses.

In this configuration, a phosphor region may be tied to an aperture in the black matrix, its area being substantially greater than that of the aperture.

In order to further increase the light efficiency, it is conceivable to cover the row electrode with phosphor regions with recesses.

BRIEF DESCRIPTION OF THE DRAWINGS

Other features and advantages of the invention will become apparent on reading the following description illustrated by the appended figures, which show:

FIG. 1, already described, an exploded view of a plasma display panel of the prior art;

In these figures, the scales are not respected for the sake of clarity.

DETAILED DESCRIPTION OF THE PREFERRED EMBODIMENTS

Figure 2A:
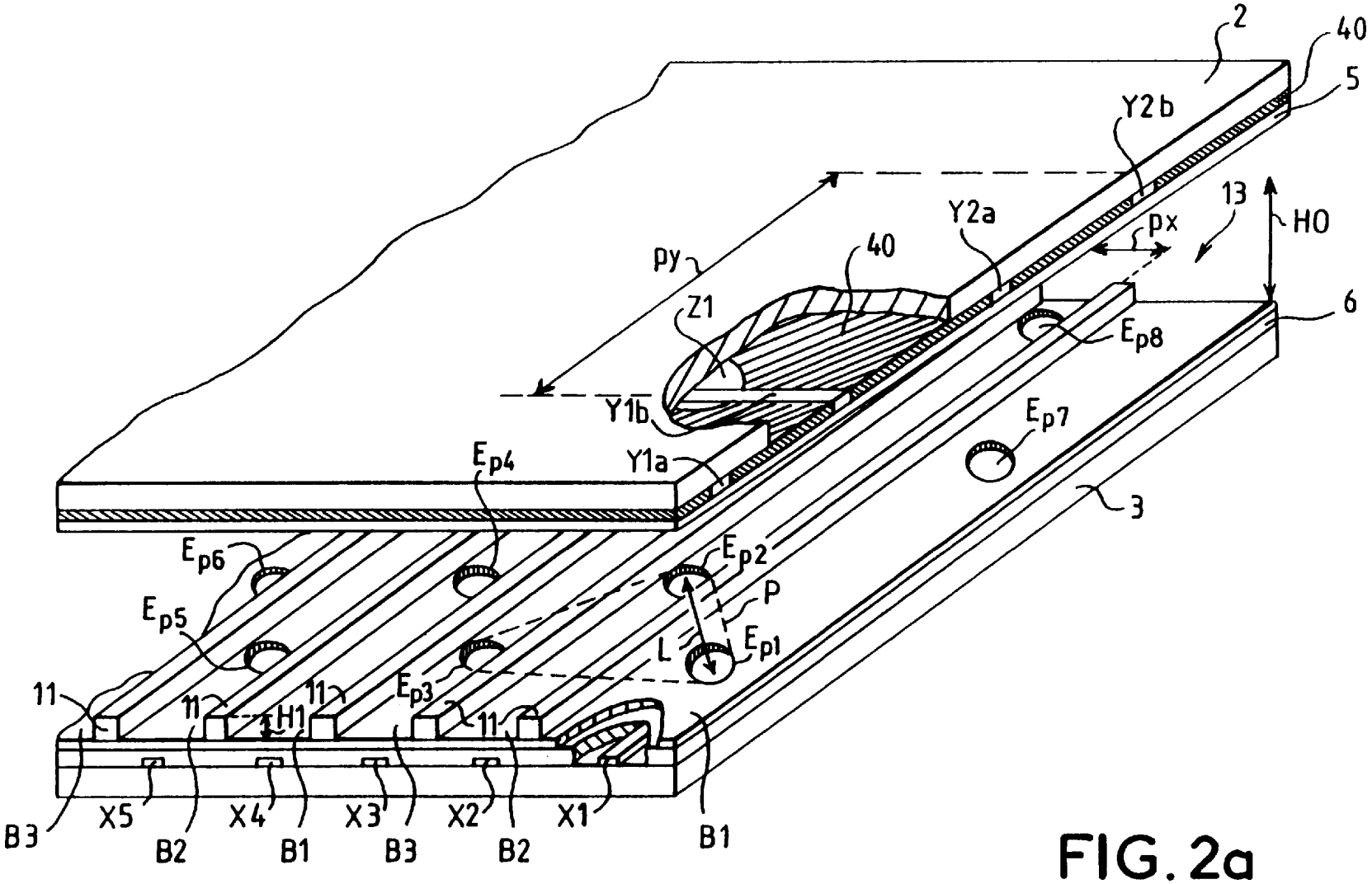
FIGS. 2*a*, 2*b*, respectively an exploded view and a front view of an example of a plasma display panel according to the invention.
Figure 2B:
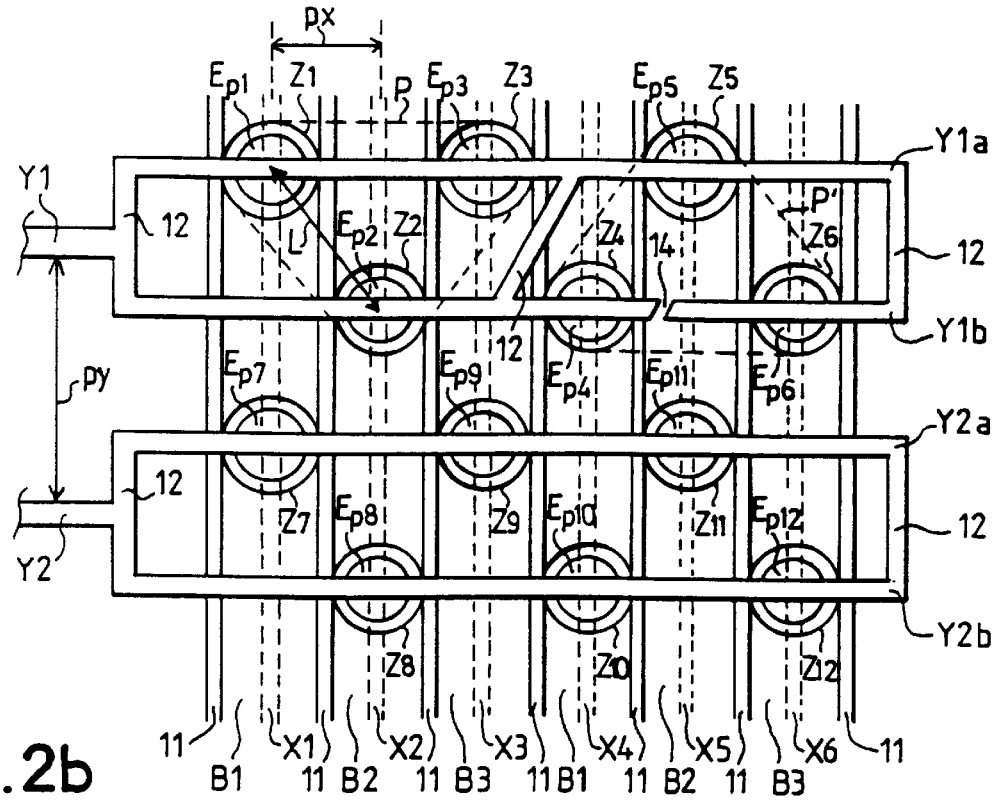

Compared with FIG. 1, FIGS. 2*a*, 2*b* again show the column electrodes X1 to X5 on the rear tile 3, these column electrodes being covered with the dielectric layer 6 which is itself covered with phosphor regions B1, B2, B3. The phosphor regions B1, B2, B3, in this case in the form of stripes, are placed approximately parallel to the column electrodes X1 to X5. The rear tile 3 also include barriers 11 separating the phosphor regions B1, B2, B3.

The phosphor regions B1, B2, B3 are provided with recesses Ep1, Ep2, Ep3, and a pixel P has at least two neighbouring recesses located at the same row electrode Y1, Y2 in adjacent phosphor regions B1, B2, B3. In the example given, a pixel P is a trichromatic pixel and has three recesses, but it is conceivable for it to have only two or more than three of them. The recesses are illustrated as circles but it is quite obvious that other shapes are possible.

Instead of two adjacent recesses Ep1, Ep2, forming part of the same pixel P and located in adjacent phosphor regions B1, B2, being separated by the spacing px of the column electrodes X1, X2, these two neighbouring recesses Ep1, Ep2 are, according to the invention, separated by a distance L which is now greater than the spacing px.

In FIGS. 2*a*, 2*b*, the recesses Ep1, Ep2, Ep3 of the same pixel P are arranged in a triangle. If the panel retains the same spacings py and px as in FIG. 1, the distance L is, for example, such that:

L=1.8 px

By increasing the distance L between neighbouring recesses Ep1, Ep2 of the same pixel P, which are located in adjacent phosphor regions, the thickness H0 of the space 13 between the two tiles may be increased with respect to that required when the recesses are distanced apart approximately equal to the spacing px. In the example described, there is a factor of 1.8 between the spacing px and the distance L and the thickness H0 may be increased by approximately the same factor.

This increase in the distance L and that in the thickness H0 which stems therefrom greatly improve the light efficiency of the panel without degrading its contrast. The new distribution of the recesses Ep1, Ep2, Ep3, etc. does not result in an increase in the difficulties of producing the rear tile 3.

With regard to the front tile 2, the same row electrode Y1 follows the recesses Ep1, Ep2, Ep3 belonging to the same pixel P. One configuration which allows this is that using subdivided row electrodes Y1, Y2. In FIG. 2, the row electrode Y1 is split into two subelectrodes Y1*a*, Y1*b* so as to pass near the three recesses Ep1, Ep2, Ep3 of the pixel P which are in a triangular configuration. With such subdivided row electrodes, the line resistance is decreased, hence a better flow of the discharge current.

The next pixel P' crossed by the same row electrode Y1 is formed from the recesses Ep4, Ep5, Ep6 in a triangular configuration, and the triangle of the pixel P is head to tail with the triangle of the pixel P'.

The two subelectrodes Y1 and Y1*b* are connected together by at least two short circuits 12. With such short circuits, a break 14 in one subelectrode between these two short circuits 12 has no effect on the array. In FIG. 2*b*, there are three short circuits 12 shown between the subelectrodes Y1*a* and Y1*b*—one upstream of the pixel P, one between the two pixels P, P' and one downstream of the pixel P'. A break 14 in the subelectrode Y1*b* is shown between the recess Ep4 and the recess Ep6, this break 14 is self-healing and discharges being able to be produced at the recess Ep6. The electrical supply for the subelectrode Y1*b* at the recess Ep6 is provided by the subelectrode Y1*a* and the short circuit 12 located downstream of the pixel P'. The larger the number of short circuits 12, the greater is the self-healing capability. This self-healing is advantageous since in high-resolution panels the row electrodes are very fine and fragile—breaks often appear. With this possibility of self-healing, the panel manufacturing yield is greatly increased since the scrap rate is reduced. Alternatively, for the same scrap rate, the electrode width can be significantly reduced, thus increasing the amount of light emitted from a recess, since there is less screening.

This duplicated row electrode Y1 evidently intersects column electrodes X1, X2, X3 outside the recesses Ep1, Ep2, Ep3, but this intersection does not give rise to discharges because, on the one hand, of the presence of the phosphor which covers the column electrodes X1, X2, X3 and, on the other hand, of the voltage level to be applied in order to obtain a discharge a recess.

Figure 3:
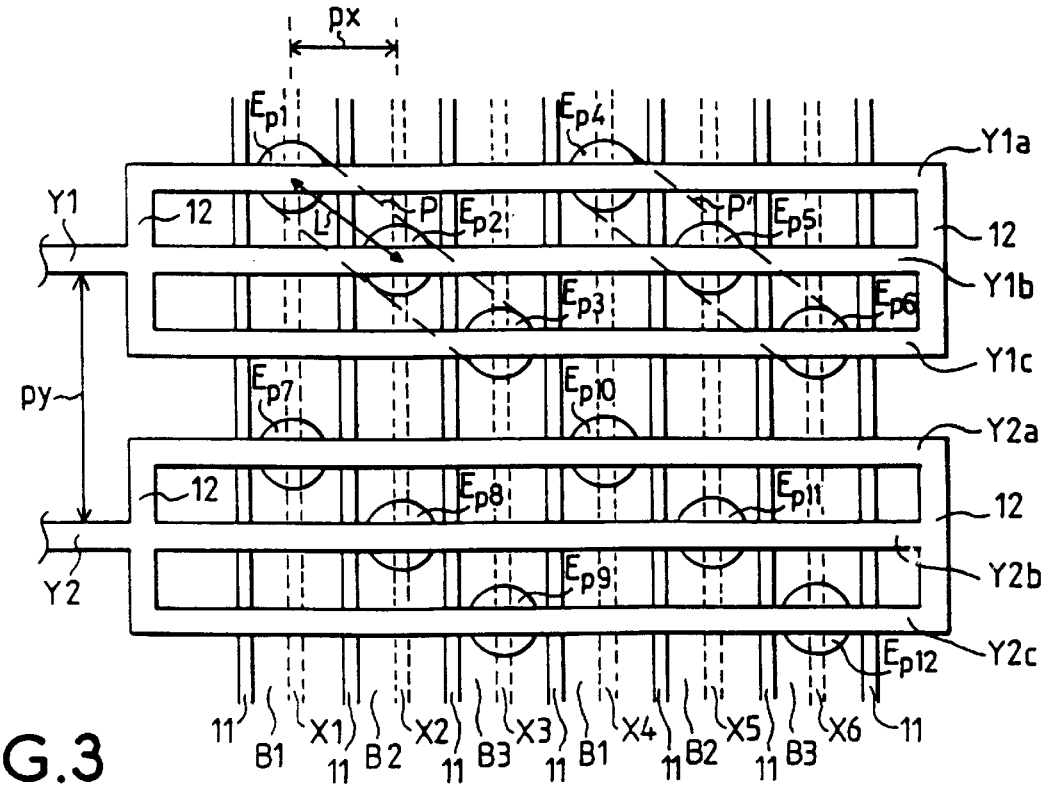
FIG. 3, a front view of an alternative form of a plasma display panel according to the invention.

In the alternative form shown in FIG. 3, the recesses Ep1, Ep2, Ep3 of the same pixel P are in the form of a line instead of being in the form of a triangle. If the panel still retains the same spacings py and px, the distance L between two neighbouring recesses Ep1, Ep2 of the same pixel P then becomes equal to:

L=1.4 px

This distance L is shorter than in the case of FIG. 2 and the efficiency of the panel will not be quite as good. In this alternative form, the row electrodes are also subdivided, but now there is a tripling. Each of the recesses Ep1, Ep2, Ep3 of a pixel P is passed by a respective subelectrode Y1*a*, Y1*b*, Y1*c*. The three subelectrodes are connected together by at least two short circuits 12. However, this structure has an advantage, which is that the recesses Ep1, Ep4 located at the same row subelectrode Y1*a* correspond to successive phosphor regions B1 of the same colour. Three recesses are therefore in alignment. This alignment results in a better image in certain types of application, for example in the case of computer images in which horizontal lines of a base colour are used.

Figure 4:
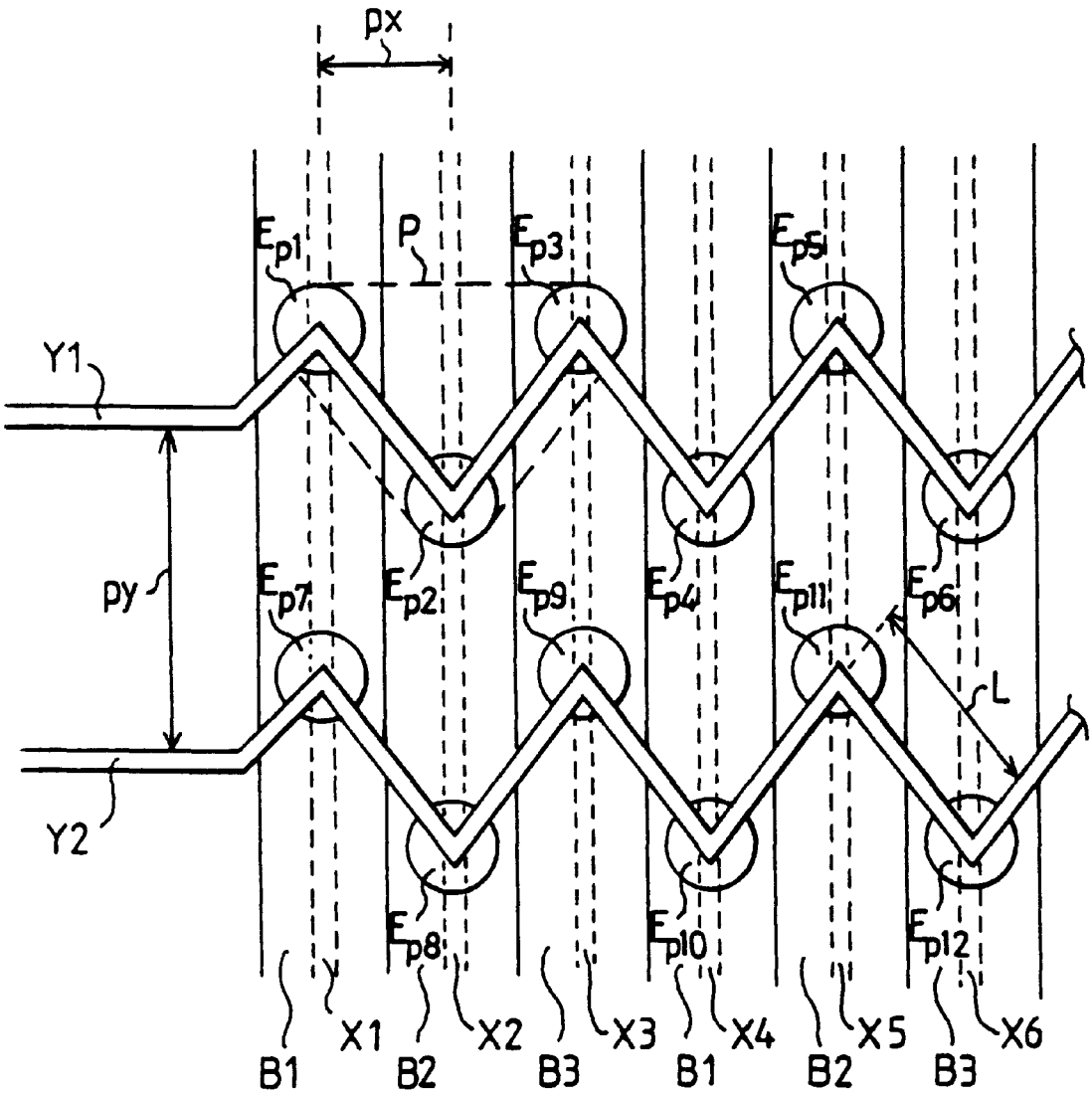
FIG. 4, a front view of an another alternative form of a plasma display panel according to the invention, with row electrodes in the form of a zig-zag.

Whereas the row electrodes Y1, Y2 are subdivided and each comprises subelectrodes so as to pass opposite all the recesses of a pixel P, it may be envisaged that they include at least one change in direction. FIG. 4 illustrates this alternative embodiment, with a pixel P whose recesses Ep1, Ep2, Ep3 are in the form of a triangle and a row electrode Y1 is in the form of a zig-zag in order to pass opposite all the recesses Ep1, Ep2, Ep3 of pixel P. Configurations other than the zig-zag configuration are quite possible.

In FIGS. 2*a*, 2*b*, barriers 11 for confining the discharges to the recesses were shown. These barriers 11, the height H1 of which is less than the thickness H0 of the gas-filled space 13 in order to favour circulation and therefore ionization, separate two adjacent phosphor regions B1, B2 relating to the same pixel. In this example the phosphor regions B1, B2 are straight and the barriers 11 are parallel, separated by a distance approximately equal to the spacing px.

In order to increase the emissive area of the discharge around the recesses Ep1, Ep2, it is conceivable for the two barriers 11 which pass on either side of a recess Ep2 to be further away from this recess Ep2 than between this recess Ep2 and its neighbour Ep8 located on the same phosphor stripe B2. Two neighbouring barriers more apart at a recess and come together between two recesses.

Figure 5A:
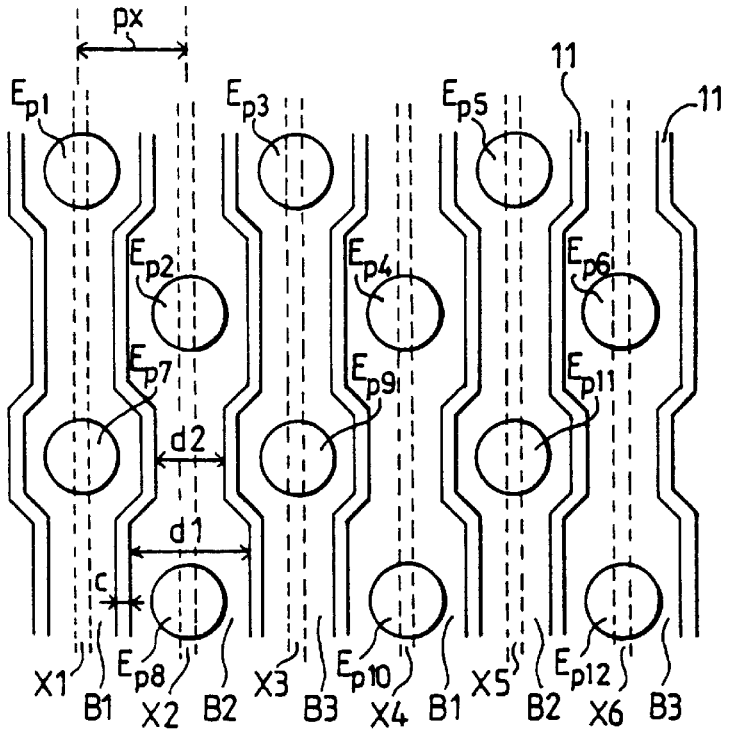
FIGS. 5*a*, 5*b*, two other alternative forms of a plasma display panel with various barrier patterns.
Figure 5B:
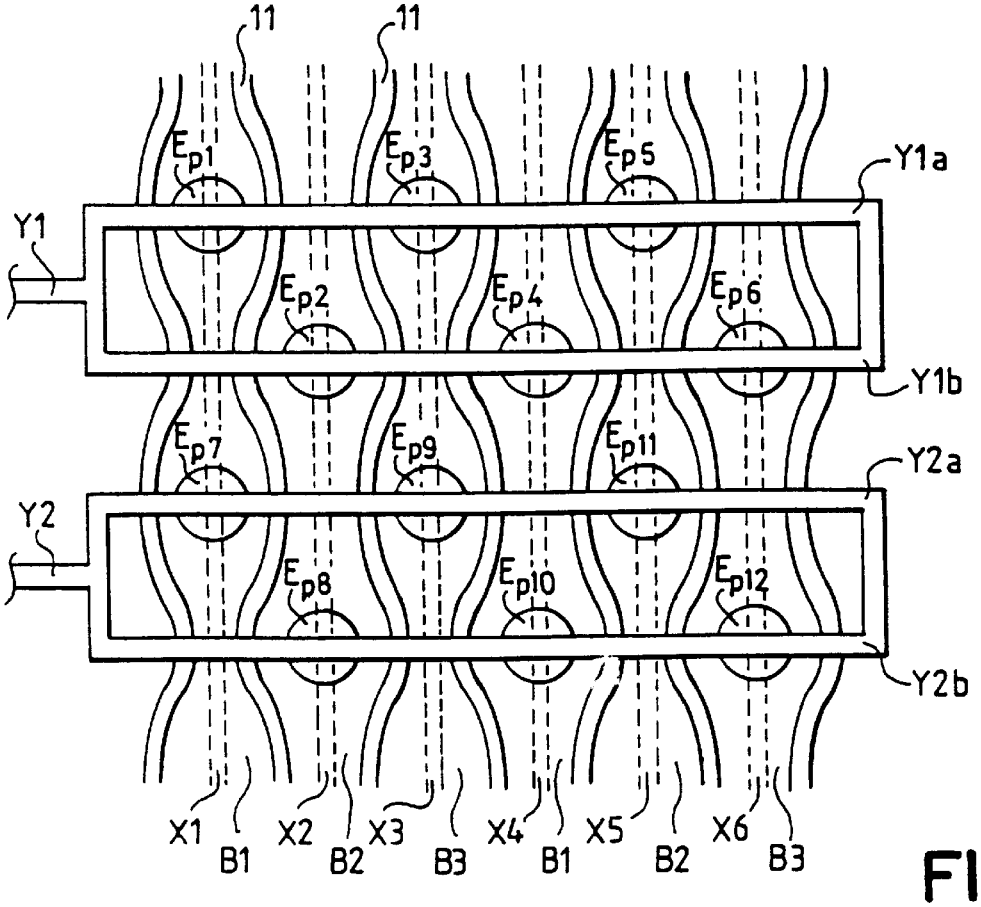

In this alternative form shown in FIG. 5*a*, in which the row electrodes are not shown for the sake of clarity, the barriers 11 change direction around the recesses Ep1, Ep2 and are in the form of kinked lines. The changes in direction may be made with an angle of approximately 45°. In FIG. 5*b*, the barriers 11 are in the form of curved, in particular approximately sinusoidal, curves.

One advantage provided by such barriers is that, since the emissive area of the discharge is increased, the constraints on matching the barriers with the recesses are relaxed. The precision in positioning the barriers with respect to the recesses can be reduced because of the shift which allows a possible certain tolerance in the positioning of the masks.

The distance d1 separating two neighbouring barriers 11 at a recess Ep8 is therefore greater than the spacing px between column electrodes X1, X2. The distance d2 separating the two barriers 11 on either side of the recess Ep8 is therefore less than the spacing px between column electrodes X1, X2. The relationship, which connects the separations d1 and d2 may be such that:

d1=d2+2c, where c is equal to the thickness of the barriers 11.

The width c of the barriers 11 may be about 19.5 micrometers if the spacing px between column electrodes is 127 micrometers.

It is recommended for the separation d2 always to be large enough not to prevent circulation of the gas.

In this alternative form, the barriers 11 are not straight and the phosphor regions B1, B2, B3 are tailored to the pattern of the barriers 11 since the barriers 11 separate two adjacent phosphor regions B1, B2, B3.

The fact of having moved two neighbouring recesses Ep1, Ep2 of the same pixel P apart, these recesses lying within adjacent phosphor regions B1, B2, makes it possible to dispense with confinement areas without degrading the quality of the discharges if the recesses Ep1, Ep2 are deep enough to confine the discharges thus created. This depth may represent about half the thickness H0 of the space 13. For example, this depth may be as much as 60 micrometers if H0 is about 110 to 120 micrometers.

Figure 6A:
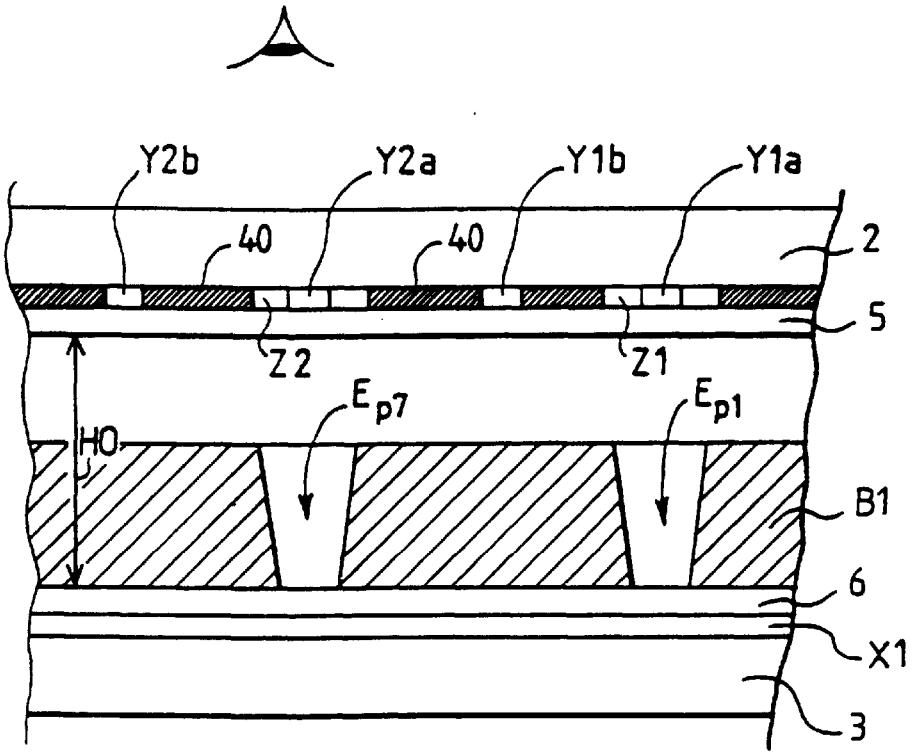
FIGS. 6*a*, 6*b*, two cross-sections respectively along a column electrode and along a row electrode of a plasma display panel according to the invention, without a barrier.
Figure 6B:
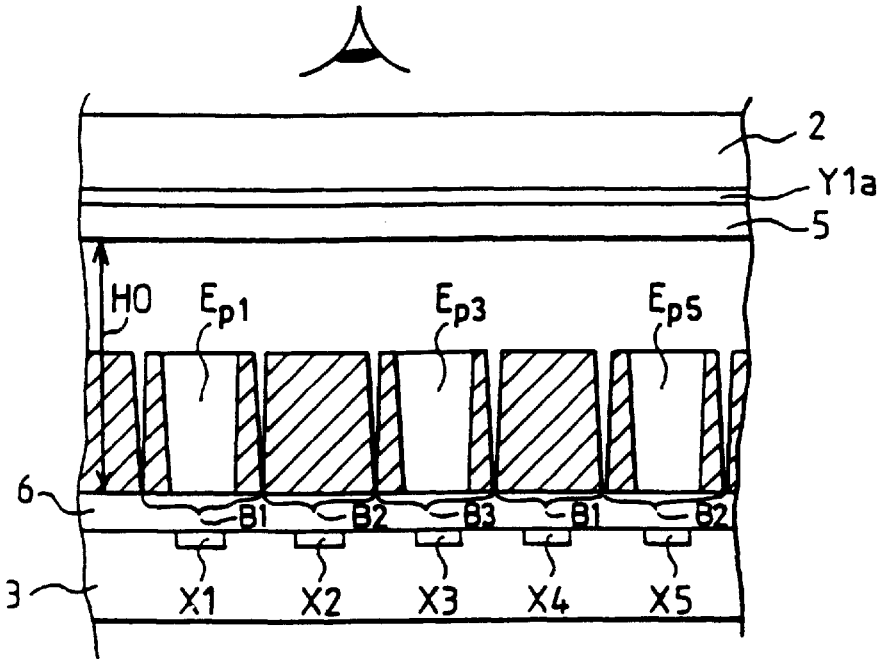

A plasma display panel according to the invention, without any barrier, is shown in FIGS. 6*a*, 6*b*. The phosphor of the various regions B1, B2, B3 has been thickened and the recesses have a depth which corresponds to the phosphor thickness.

This thickness makes it possible to form true discharge-confining wells—these wells prevent the propagation of the discharges towards neighbouring recesses at which a discharge must not take place. They therefore prevent a crosstalk effect between neighbouring recesses.

These wells also prevent the ultraviolet radiation created by a discharge in a given recess from exciting the phosphor material of neighbouring regions and causing a lack of saturation of the colours. This phenomenon is known as a vision crosstalk effect. Good localization of the discharges is possible.

Figure 7A:
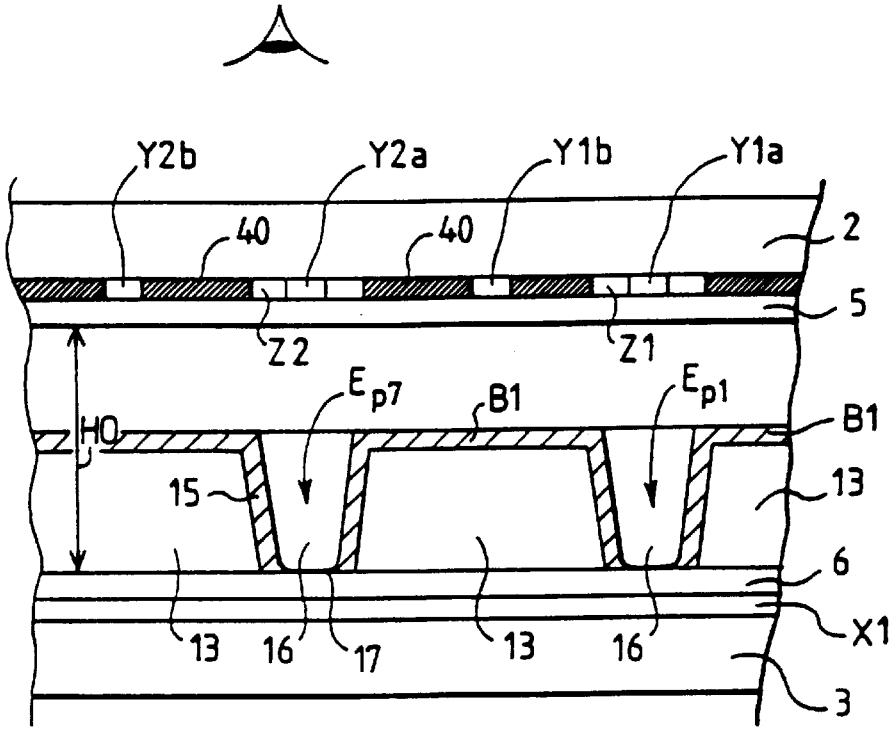
FIGS. 7*a*, 7*b*, two cross-sections respectively along a column electrode and along a row electrode of a plasma display panel according to the invention with a well in a sublayer of additional material.
Figure 7B:
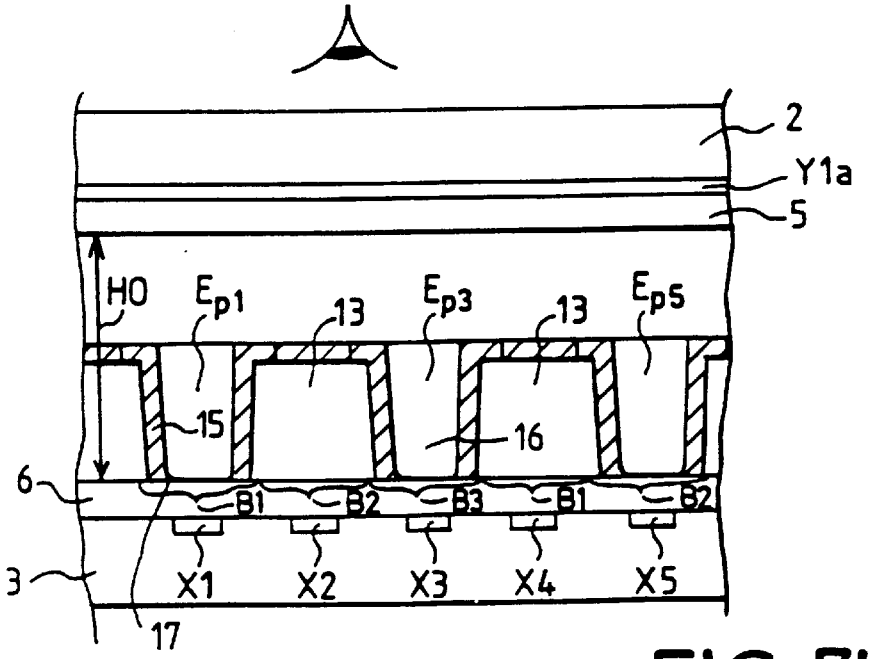

Another way of producing these deep recesses Ep1, Ep2, Ep3, illustrated in FIGS. 7*a*, 7*b*, is to deposit beforehand, on the dielectric material 6, a sublayer 13 of an additional material, to make wells 16 in it and to cover this sublayer 13 with a thinner layer of phosphor so as to form the various regions B1, B2, B3. The phosphor lines the sides 15 of the wells 16—it does not fill them. Optionally, it may spill over onto the bottom 17 of the wells 16. Recesses Ep1, Ep2, Ep3 of the desired thickness are therefore obtained, while limiting the amount of phosphor used.

The cross-section of the wells 16 is preferably greater than that of the recesses in order to take into account the phosphor. The additional material for the sublayer 13 is preferably chosen so as to be reflecting and to be white in colour.

The additional material may contain alumina and/or titanium oxide and/or yttrium oxide. This sublayer 13 may be deposited by screen printing or photolithograpically etched.

Omitting the barriers considerably reduces the manufacturing costs since barrier production represents approximately half the manufacturing cost of the tile. A saving in cycle time is thus achieved. The open structure obtained favours ionization of the gas at low luminance levels and therefore improves the operation of the panel.

In FIG. 2*a*, phosphor regions B1, B2, B3 occupy the entire area of the tile 3 on which they are deposited. They form contiguous stripes which follow the column electrodes X1, X2, X3, each having several recesses. The discharges can only be produced at the recesses, as was explained previously. With the use of the sublayer 13 under the phosphor, it is possible to reduce the area of the phosphor regions B1, B2, B3 with respect to that of the tile 3. The material cost saving is appreciable, since the phosphors are expensive materials.

Figure 8A:
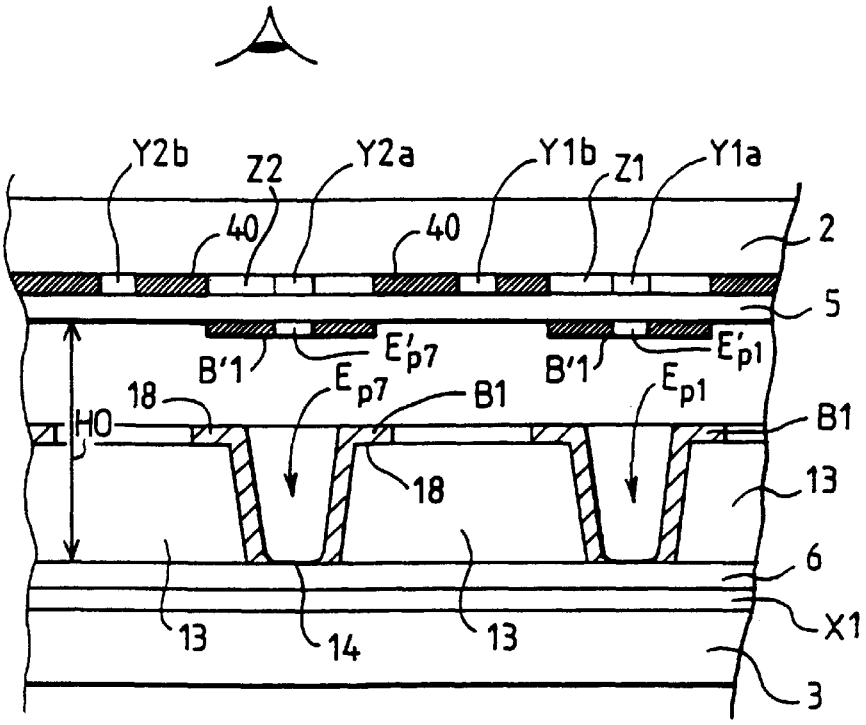
FIGS. 8*a*, 8*b*, two cross-sections respectively along a column electrode and along a row electrode of a plasma display panel according to the invention, with phosphor regions which terminate in a rim around the wells.
Figure 8B:
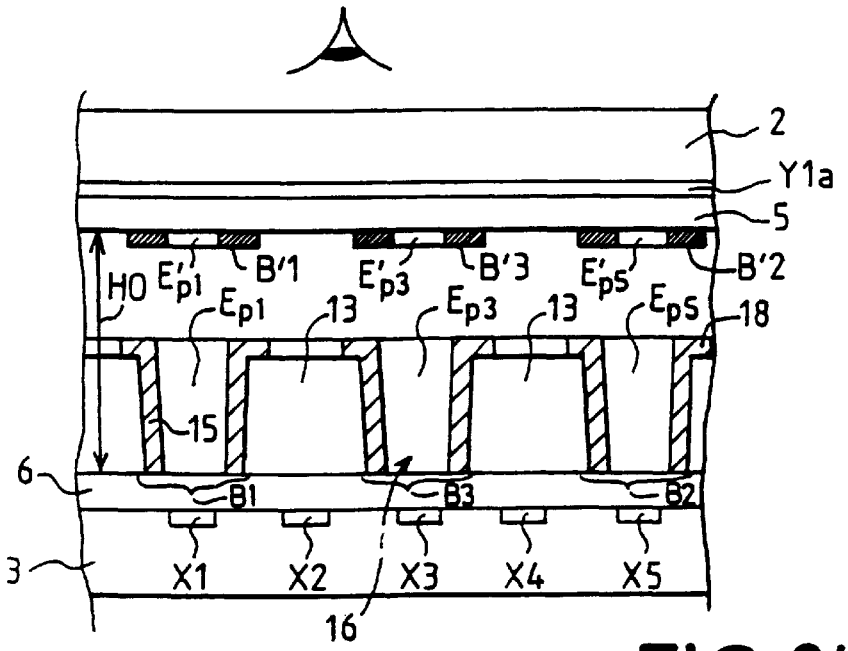

FIGS. 8*a*, 8*b* illustrate this configuration. A phosphor region B1, B2, B3 lines the sides 15 of a well 16 in the sublayer 13 and terminates in a rim 18 which follows the mouth of the well 16. Seen from above, the phosphor regions B1, B2, B3 are configured in the form of a disc. A phosphor region has only one recess. The sublayer 13 is in contact with the gas at certain points. The sublayer 13 then provides protection, aiming to prevent discharges from being able to occur at the intersection of a row electrode with a column electrode but outside the recess. In FIG. 8*b*, it should be noted that there is no phosphor region at the intersection of the column electrodes X2 with the row electrode Y1*a*. The sublayer 13 prevents a discharge from being able to occur at this point.

Having recesses Ep1, Ep2, Ep3 further apart than in the prior art, for example arranged as shown in FIG. 2*b*, it is possible to increase the area of the black matrix 40 with respect to the total area of the front panel 2.

According to the invention, as illustrated in FIGS. 2*a*, 2*b*, the black matrix 40 now covers approximately the entire front tile 2, apart from apertures Z1, Z2, etc., which are arranged facing the recesses Ep1, Ep2, and which are tied to the latter. Each aperture Z1, Z2 is associated with a recess Ep1, Ep2 and has an area slightly greater than that of the recess Ep1, Ep2 with which it is associated.

For example, for a so-called high-definition plasma panel, with a spacing px between column electrodes of 127 micrometers, and in which the distance L between neighbouring recesses Ep1, Ep2 lying in adjacent phosphor regions is 229 micrometers, if the apertures Z1, Z2 in the black matrix 40 have a diameter of 180 micrometers, the amount of coverage of the black matrix 40 is approximately 60% whereas, with apertures Z1, Z2 whose diameter is approximately 150 micrometers, the amount of coverage of the black matrix 40 is about 80%. Such an amount of coverage is equivalent to an actual diffuse reflectivity of the front tile 2 of the plasma panel of about 10%. This black matrix 40, which is more extensive than in the prior art, therefore allows the intrinsic contrast of the panel to be advantageously increased.

In the configuration with a reflecting sublayer 13 in contact with the gas, it is possible for a phosphor region B1, B2, B3 to be circumscribed around an aperture Z1, Z2 in the black matrix 40. This alternative form is shown in FIG. 8*a*. A phosphor region B1, B2, B3, being tied to an aperture Z1, Z2, will preferably have an area slightly greater than that of the aperture Z1, Z2 so as to avoid any problem if there is any mismatch between the two tiles or their components.

This type of two-substrate alternating plasma display panel may also receive phosphor regions B'1, B'2, B'3 on its front face.

A thin phosphor layer emits both in transmission and in reflection. It is therefore easy to deposit the various phosphor regions B'1, B'2, B'3 with recesses Ep'1, Ep'2, Ep'3, etc., on the front face 2 by tying them to the recesses Ep1, Ep2, Ep3 of the rear face 3.

Depending on their colour, the phosphor regions may either by deposited one after the other by screen printing, followed by a single exposure and stripping operation, or be deposited as a uniform layer over the entire surface, followed by one exposure and stripping operation per colour. The light efficiency is therefore increased by at least 1.5.

What is claimed is:

1. Colour two-substrate-type alternating plasma display panel comprising two tiles joined together so as to be opposite each other, defining a space intended to be filled with gas, one of the tiles having column electrodes which are approximately parallel, separated by a spacing and covered with at least one phosphor region, the other tile having at least one row electrode, the phosphor regions being provided with at least one recess placed at the intersection of a row electrode with a column electrode, in order to localize the discharges that can be produced in the gas between the two electrodes, a colour pixel being formed by neighbouring recesses located in adjacent phosphor regions, within the row electrode, characterized in that, in order to obtain a better light efficiency, the distance separating two neighbouring recesses of the same pixel is greater than the spacing of the column electrodes so as to allow the space to have a thickness greater than that required when the two neighbouring recesses are separated by a distance approximately equal to the spacing.

2. Panel according to claim 1, characterized in that the recesses of the same pixel (P) are arranged in a triangle.

3. Panel according to claim 1, characterized in that the recesses of the same pixel are arranged in a line.

4. Panel according to claim 1, characterized in that the row electrode is subdivided into several subelectrodes.

5. Panel according to claim 4, characterized in that the subelectrodes are connected together by at least two short circuits with a view to allowing self-healing should there be a break in one of them.

6. Panel according to claim 1, characterized in that the row electrode has a least one change of direction.

7. Panel according to claim 6, characterized in that the row electrode is in the form of a zig-zag.

8. Panel according to claim 1, characterized in that it includes barriers which separate two adjacent phosphor regions, these barriers having a height less than the thickness of the space.

9. Panel according to claim 8, characterized in that two successive barriers are further apart at a recess than on either side of this recess.

10. Panel according to claim 9, characterized in that at least one barrier is in the form of a kinked line.

11. Panel according to claim 9, characterized in that at least one barrier is in the form of a curved line.

12. Panel according to claim 1, characterized in that the recesses are deep enough to confine the discharges so as to avoid the use of barriers separating two adjacent phosphor regions.

13. Panel according to claim 12, characterized in that the depth of the recesses is about half the thickness of the space.

14. Panel according to claim 12, characterized in that the recesses are formed from wells in a sublayer of an additional material, these wells being lined with phosphor without being filled up.

15. Panel according to claim 14, characterized in that the additional material is reflecting.

16. Panel according to claim 14, characterized in that the additional material is white.

17. Panel according to claim 1, characterized in that the additional material contains alumina and/or titanium oxide and/or yttrium oxide.

18. Panel according to claim 14, characterized in that a phosphor region terminates in a rim which follows the mouth of a well.

19. Panel according to claim 1, which includes a black matrix on the tile with the row electrode, characterized in that the black matrix covers the tile apart from apertures which face the recesses and are tied to the recesses, these apertures having an area substantially greater than that of the recesses.

20. Panel according to claim 19, characterized in that a phosphor region is tied to an aperture in the black matrix, its area being substantially greater than that of the aperture.

21. Panel according to claim 1, characterized in that the row electrode is covered with phosphor regions with recesses.

* * * * *